US010828747B2

(12) United States Patent
Hiroo et al.

(10) Patent No.: US 10,828,747 B2
(45) Date of Patent: Nov. 10, 2020

(54) SUBSTRATE POLISHING APPARATUS AND METHOD

(71) Applicant: EBARA CORPORATION, Tokyo (JP)

(72) Inventors: Yasumasa Hiroo, Tokyo (JP); Keita Yagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 360 days.

(21) Appl. No.: 16/025,515

(22) Filed: Jul. 2, 2018

(65) Prior Publication Data

US 2019/0009385 A1 Jan. 10, 2019

(30) Foreign Application Priority Data

Jul. 5, 2017 (JP) ..... 2017-131968

(51) Int. Cl.

| | |
|---|---|
| ***B24B 53/017*** | (2012.01) |
| ***B24B 37/005*** | (2012.01) |
| ***B24B 49/10*** | (2006.01) |
| ***B24B 37/013*** | (2012.01) |
| ***B24B 37/10*** | (2012.01) |
| ***B24B 49/12*** | (2006.01) |

(52) U.S. Cl.

CPC ..... *B24B 53/017* (2013.01); *B24B 37/005* (2013.01); *B24B 37/013* (2013.01); *B24B 37/107* (2013.01); *B24B 49/105* (2013.01); *B24B 49/12* (2013.01)

(58) Field of Classification Search

CPC ... B24B 53/017; B24B 37/005; B24B 37/013; B24B 37/107; B24B 49/105; B24B 49/12

See application file for complete search history.

(56) References Cited

U.S. PATENT DOCUMENTS

| | | | | |
|---|---|---|---|---|
| 9,108,292 | B2 * | 8/2015 | Shimano | B24B 53/005 |
| 9,156,122 | B2 * | 10/2015 | Shinozaki | B24B 49/18 |
| 9,156,130 | B2 * | 10/2015 | Shimano | B24B 37/005 |
| 9,943,943 | B2 * | 4/2018 | Shinozaki | B24B 49/04 |
| 9,962,804 | B2 * | 5/2018 | Shinozaki | B24B 49/10 |
| 10,016,871 | B2 * | 7/2018 | Shinozaki | B24B 53/017 |
| 2014/0287653 | A1 | 9/2014 | Shimano et al. | |

FOREIGN PATENT DOCUMENTS

JP 2014-161944 A 9/2014

* cited by examiner

*Primary Examiner* — Dung Van Nguyen
(74) *Attorney, Agent, or Firm* — Pearne & Gordon LLP

(57) ABSTRACT

A polishing apparatus comprises a dresser that can adjust swing speed in the scanning areas set on a polishing member along a swing direction, a height detection section that measures a surface height of the polishing member in a plurality of monitoring areas set on the polishing member along the swing direction of the dresser, a dress model matrix creation section that creates a dress model matrix defined from a plurality of monitoring areas, scanning areas and a dress model, an evaluation index creation section that calculates a height profile predicted value using the dress model, the swing speed in each scanning area or a staying time and sets evaluation index based on a difference from a target value of height profile of the polishing member and a moving speed calculation section that calculates the swing speed in each scanning area of the dresser based on the evaluation index.

20 Claims, 9 Drawing Sheets

SUBSTRATE POLISHING APPARATUS AND METHOD

CROSS-REFERENCE TO RELATED APPLICATIONS

This application claims the benefit of Japanese Priority Patent Application JP 2017-131968 filed on Jul. 5, 2017, the entire contents of which are incorporated herein by reference.

BACKGROUND OF THE INVENTION

Field of the Invention

The present invention relates to a profile adjustment method for a polishing member to polish a substrate such as a wafer, and a polishing apparatus.

Description of the Related Art

As high-density integration of semiconductor devices advances, circuit wiring is becoming finer and dimensions of integrated devices are also becoming smaller. Steps of polishing a wafer having a metallic film or the like formed on its surface and flattening the surface of the wafer are therefore needed. One such flattening method is polishing by a chemical-mechanical polishing (CMP) apparatus. The chemical-mechanical polishing apparatus includes a polishing member (polishing cloth, polishing pad or the like) and a holding portion (top ring, polishing head, chuck or the like) for holding a polishing target such as a wafer. While supplying a polishing liquid (abrasive liquid, chemical liquid, slurry, pure water or the like) between the polishing member and the polishing target, the chemical-mechanical polishing apparatus pushes the surface of the polishing target (polished surface) against the surface of the polishing member and causes the polishing member and the polishing target to relatively move with respect to each other, and thereby polishes the surface of the polishing target flat.

Foamed resin or non-woven fabric cloth is generally used as a polishing member material used for such a chemical-mechanical polishing apparatus. The polishing member has fine projections and depressions on its surface and the fine projections and depressions act as a chip pocket which is effective in preventing clogging or reducing polishing resistance. However, continued polishing of the polishing target with the polishing member may cause the fine projections and depressions on the surface of the polishing member to be crushed and cause a reduction of a polishing rate. Therefore, the polishing member surface is dressed using a dresser in which many abrasive grains such as diamond particles are electrodeposited, and the fine projections and depressions are reconstructed on the polishing member surface.

As a dressing method for the polishing member, for example, dressing is performed while moving (circular or linear reciprocating motion or swinging) a rotating dresser, with the dressing surface being pushed against the rotating polishing member. When dressing the polishing member, a minute amount of the surface of the polishing member is shaved. Therefore, inappropriate dressing may result in inappropriate undulation on the surface of the polishing member, causing inconvenience of producing a variation within the polishing rate in the polished surface. The variation in the polishing rate may cause a polishing defect, and it is therefore necessary to perform dressing appropriately so as to prevent inappropriate undulation on the surface of the polishing member. That is, variations in the polishing rate are avoided by performing dressing under appropriate dressing conditions such as an appropriate rotation speed of the polishing member, an appropriate rotation speed of the dresser, an appropriate dressing load and an appropriate moving speed of the dresser.

In a polishing apparatus disclosed in Japanese Patent Laid-Open No. 2014-161944, a plurality of swing sections are set in a swing direction of a dresser, a difference between a current profile obtained from a measured value of a surface height of a polishing member in each swing section and a target profile is calculated and a moving speed of the dresser in each swing section is corrected so as to eliminate the difference.

However, when, for example, the difference from the target profile is large, the variation in the dresser moving speed in each swing section increases even using the correction method disclosed in the above-described Patent Literature, and the dresser moving speed is not stable, and as a result, the intended profile of the polishing member cannot be obtained.

The present invention has been implemented to the above, and it is an object of the present invention to provide a profile adjustment method for a polishing member capable of implementing a profile of a target polishing member. Furthermore, it is another object of the present invention to provide a polishing apparatus capable of executing such a profile adjustment method for such a polishing member.

SUMMARY OF THE INVENTION

In order to attain the aforementioned objects, a polishing apparatus according to the present invention includes a dresser, a swing speed of which is adjustable in a plurality of scanning areas set on a polishing member along a swing direction, a height detection section that measures a surface height of the polishing member in a plurality of monitoring areas set in advance on the polishing member along the swing direction of the dresser, a dress model matrix creation section that creates a dress model matrix defined from a plurality of monitoring areas, scanning areas and a dress model, an evaluation index creation section that calculates a height profile predicted value using the dress model, the swing speed in each scanning area or a staying time and sets an evaluation index based on a difference from a target value of a height profile of the polishing member and a moving speed calculation section that calculates the swing speed in each scanning area of the dresser based on the evaluation index.

The evaluation index creation section in the above-described polishing apparatus preferably sets an evaluation index based on a difference between the moving speed in the scanning area and a moving speed reference value. The evaluation index creation section preferably sets an evaluation index based on a difference in the moving speed between the neighboring scanning areas or a difference in the moving speed reference value between the neighboring scanning areas. Furthermore, the evaluation index creation section preferably sets weighting factors for a difference from a target value of a height profile of the polishing member, a difference from a reference value of the moving speed and a difference in the moving speed between the neighboring scanning areas.

The polishing apparatus is preferably provided with a cut rate calculation section that calculates cut rates of the polishing member in a plurality of monitoring areas. The polishing apparatus is preferably further provided with a memory section that stores the cut rate of the polishing member from measured values of the surface height and configured to estimate a height profile of the polishing member based on the stored cut rate.

As a dresser swing speed calculation condition, it is preferable to provide constraints on a total time of a time period during which the dresser stays in each scanning area and/or an upper limit value and a lower limit value of the swing speed of the dresser. An optimization calculation for minimizing the evaluation index may be executed to calculate the swing speed of the dresser and the optimization calculation is preferably a quadratic programming method.

Another aspect of the present invention is a method of dressing a polishing member used for a substrate polishing apparatus by swinging a dresser on the polishing member, a swing speed of the dresser being adjustable in a plurality of scanning areas set on the polishing member along a swing direction, the method including a step of measuring a surface height of the polishing member in a plurality of monitoring areas set in advance on the polishing member along the swing direction of the dresser, a step of creating a dress model matrix defined from the monitoring areas, the scanning areas and a dress model, a step of calculating a height profile predicted value using the swing speed or a staying time in the dress model and each scanning area, a step of setting an evaluation index based on a difference from a height profile target value of the polishing member and a step of setting the swing speed in each scanning area of the dresser based on the evaluation index.

DETAILED DESCRIPTION OF THE PREFERRED EMBODIMENTS

Figure 1:
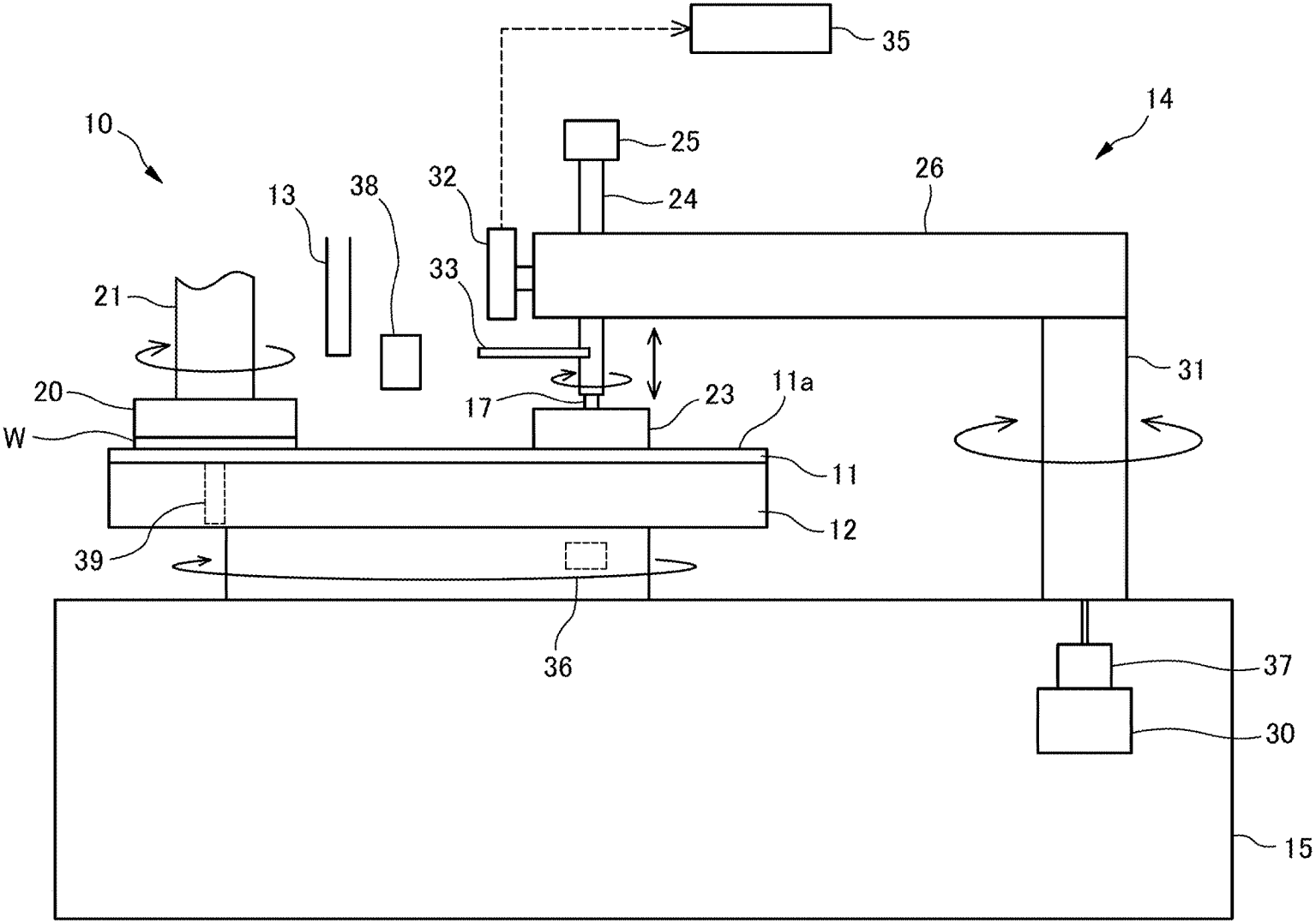
FIG. 1 is a schematic view illustrating a polishing apparatus that polishes a substrate such as a wafer.

An embodiment of the present invention will be described with reference to the accompanying drawings. FIG. 1 is a schematic view illustrating a polishing apparatus that polishes a substrate such as a wafer. The polishing apparatus is provided on a substrate processing apparatus that can perform a series of steps of polishing, cleaning and drying a wafer.

As shown in FIG. 1, the polishing apparatus is provided with a polishing unit 10 for polishing a wafer W, a polishing table 12 that holds a polishing pad (polishing member) 11, a polishing liquid supply nozzle 13 that supplies a polishing liquid to the polishing pad 11, and a dressing unit 14 that performs conditioning (dressing) on the polishing pad 11 used to polish the wafer W. The polishing unit 10 and the dressing unit 14 are set on a base 15.

The polishing unit 10 is provided with a top ring (substrate holding section) 20 connected at a bottom end of a top ring shaft 21. The top ring 20 is configured to hold the wafer W on an undersurface thereof by means of vacuum suctioning. The top ring shaft 21 is rotated driven by a motor (not shown) and the rotation of the top ring shaft 21 causes the top ring 20 and the wafer W to rotate. The top ring shaft 21 is configured to move in a vertical direction relative to the polishing pad 11 by a vertical movement mechanism (not shown) (e.g., vertical movement mechanism composed of a servo motor and a ball screw).

The polishing table 12 is connected to a motor 22 disposed therebelow. The polishing table 12 is rotated by the motor 22 around a shaft center thereof. The polishing pad 11 is pasted to a top surface of the polishing table 12 and a top surface of the polishing pad 11 constitutes a polishing surface 11*a* for polishing the wafer W.

The wafer W is polished as follows. The top ring 20 and the polishing table 12 are caused to rotate respectively and a polishing liquid is supplied to the polishing pad 11. In this condition, the top ring 20 holding the wafer W is caused to descend and the wafer W is pushed against a polishing surface 11*a* of the polishing pad 11 through a pressurizing mechanism (not shown) made up of an airbag set in the top ring 20. The wafer W and the polishing pad 11 are brought into slidable contact with each other in the presence of the polishing liquid and the surface of the wafer W is thereby polished and flattened.

The dressing unit 14 is provided with a dresser 23 that comes into contact with the polishing surface 11*a* of the polishing pad 11, a dresser shaft 24 connected to the dresser 23, an air cylinder 25 provided at a top end of the dresser shaft 24 and a dresser arm 26 that rotatably supports the dresser shaft 24. Abrasive grains such as diamond particles are fixed to an undersurface of the dresser 23. The undersurface of the dresser 23 constitutes a dressing surface for dressing the polishing pad 11.

The dresser shaft 24 and the dresser 23 are movable in the vertical direction with respect to the dresser arm 26. The air cylinder 25 is an apparatus that gives a dressing load on the polishing pad 11 to the dresser 23. The dressing load is adjustable by an air pressure supplied to the air cylinder 25.

The dresser arm 26 is configured to be driven by a motor 30 and swing around a spindle 31. The dresser shaft 24 is caused to rotate by a motor (not shown) disposed in the dresser arm 26 and the rotation of the dresser shaft 24 causes the dresser 23 to rotate around a shaft center thereof. The air cylinder 25 pushes the dresser 23 against the polishing surface 11*a* of the polishing pad 11 with a predetermined load via the dresser shaft 24.

Conditioning of the polishing surface 11*a* of the polishing pad 11 is performed as follows. The polishing table 12 and the polishing pad 11 are caused to rotate by the motor 22 and a dressing liquid (e.g., pure water) is supplied from a dressing liquid supply nozzle (not shown) to the polishing surface 11*a* of the polishing pad 11. Furthermore, the dresser 23 is caused to rotate around the shaft center thereof. The dresser 23 is pressed against the polishing surface 11*a* by the air cylinder 25 to cause the undersurface (dressing surface) of the dresser 23 to slidably contact with the polishing surface 11*a*. In this condition, the dresser arm 26 is caused to turn and the dresser 23 on the polishing pad 11 is caused to swing in a substantially radius direction of the polishing pad 11. The polishing pad 11 is shaved by the rotating dresser 23 and conditioning of the polishing surface 11*a* is thereby performed.

A pad height sensor (surface height measuring instrument) 32 for measuring a height of the polishing surface 11*a* is fixed to the dresser arm 26. A sensor target 33 located opposed to the pad height sensor 32 is fixed to the dresser shaft 24. The sensor target 33 moves in the vertical direction together with the dresser shaft 24 and the dresser 23, whereas the position in the vertical direction of the pad height sensor 32 is fixed. The pad height sensor 32 is a displacement sensor and can indirectly measure the height (thickness of the polishing pad 11) of the polishing surface 11*a* by measuring displacement of the sensor target 33. Since the sensor target 33 is connected to the dresser 23, the pad height sensor 32 can measure the height of the polishing surface 11*a* during conditioning of the polishing pad 11.

The pad height sensor 32 measures the height of the polishing surface 11*a* in a plurality of predetermined areas (monitoring areas) divided in the radius direction of the polishing pad. The pad height sensor 32 indirectly measures the polishing surface 11*a* from a position in the vertical direction of the dresser 23 which is in contact with the polishing surface 11*a*. Therefore, the pad height sensor 32 measures an average of the height of the polishing surface 11*a* in an area (certain monitoring area) with which the undersurface (dressing surface) of the dresser 23 is in contact, and measures the height of the polishing pad in a plurality of monitoring areas, and is thereby capable of obtaining a profile of the polishing pad (cross-sectional shape of the polishing surface 11*a*). As the pad height sensor 32, all types of sensors can be used such as a linear scale sensor, a laser type sensor, an ultrasonic sensor or an eddy current type sensor.

The pad height sensor 32 is connected to a dressing monitoring apparatus 35 and an output signal of the pad height sensor 32 (that is, a measured value of the height of the polishing surface 11*a*) is sent to the dressing monitoring apparatus 35. The dressing monitoring apparatus 35 acquires the profile of the polishing pad 11 from the measured value of the height of the polishing surface 11*a* and is further provided with a function of determining whether or not conditioning of the polishing pad 11 is correctly in progress.

The polishing apparatus is provided with a table rotary encoder 36 that measures an angle of rotation of the polishing table 12 and polishing pad 11 and a dresser rotary encoder 37 that measures a turning angle of the dresser 23. These table rotary encoder 36 and dresser rotary encoder 37 are absolute encoders that measure absolute values of angles. These rotary encoders 36 and 37 are connected to the dressing monitoring apparatus 35, and the dressing monitoring apparatus 35 can acquire the angles of rotation of the polishing table 12 and the polishing pad 11 and further the turning angle of the dresser 23 during height measurement of the polishing surface 11*a* by the pad height sensor 32.

Figure 2:
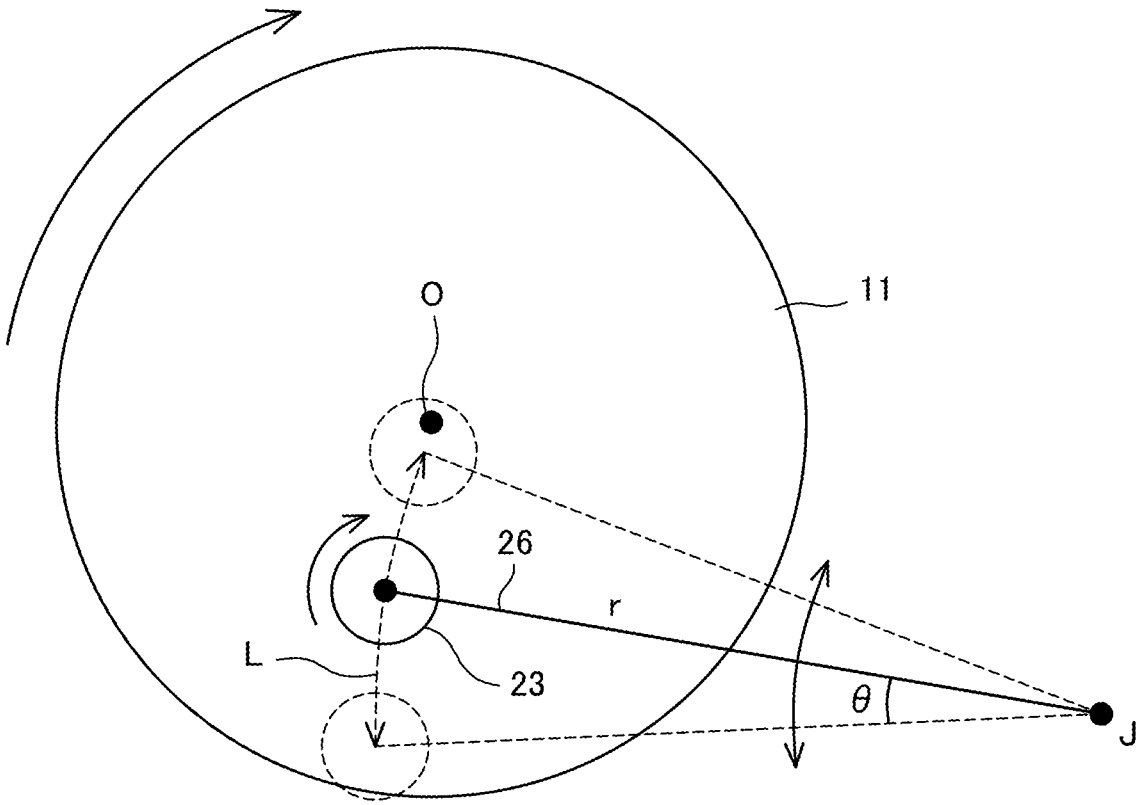
FIG. 2 is a plan view schematically illustrating a dresser and a polishing pad.

The dresser 23 is connected to the dresser shaft 24 via a universal joint 17. The dresser shaft 24 is connected to a motor (not shown). The dresser shaft 24 is rotatably supported by the dresser arm 26 and the dresser arm 26 causes the dresser 23 to swing in a radius direction of the polishing pad 11 while being in contact with the polishing pad 11 as shown in FIG. 2. The universal joint 17 is configured to transmit the rotation of the dresser shaft 24 to the dresser 23 while allowing tilt of the dresser 23. The dresser 23, the universal joint 17, the dresser shaft 24, the dresser arm 26 and a rotation mechanism (not shown) or the like constitute the dressing unit 14. The dressing monitoring apparatus 35 for calculating a sliding distance and a sliding speed of the dresser 23 is electrically connected to the dressing unit 14. A dedicated or general-purpose computer may be used as the dressing monitoring apparatus 35.

Abrasive grains such as diamond particles are fixed to the undersurface of the dresser 23. The portion to which the abrasive grains are fixed constitutes the dressing surface for dressing the polishing surface of the polishing pad 11. Examples of aspects of the applicable dressing surface include a circular dressing surface (dressing surface on which abrasive grains are fixed to the entire undersurface of the dresser 23), a ring-shaped dressing surface (dressing surface on which abrasive grains are fixed to peripheral edges of the undersurface of the dresser 23) or a plurality of circular dressing surfaces (dressing surface on which abrasive grains are fixed to surfaces of a plurality of small-diameter pellets arrayed at substantially equal intervals around the center of the dresser 23). Note that the dresser 23 in the present embodiment is provided with the circular dressing surface.

When the polishing pad 11 is dressed, the polishing pad 11 is caused to rotate in a direction shown by an arrow at a predetermined rotational speed as shown in FIG. 1, and the dresser 23 is caused by a rotation mechanism (not shown) to rotate in a direction shown by an arrow at a predetermined rotational speed. In this condition, the dressing surface of the dresser 23 (surface on which abrasive grains are placed) is pressed against the polishing pad 11 with a predetermined dressing load and the polishing pad 11 is dressed. The dresser arm 26 causes the dresser 23 to swing over the polishing pad 11, and can thereby perform dressing of the area used in polishing of the polishing pad 11 (polishing area, that is, area for polishing a polishing target such as a wafer).

Since the dresser 23 is connected to the dresser shaft 24 via the universal joint 17, even when the dresser shaft 24 is slightly tilted with respect to the surface of the polishing pad 11, the dressing surface of the dresser 23 is appropriately brought into contact with the polishing pad 11. A pad surface roughness measuring device 38 for measuring surface roughness of the polishing pad 11 is disposed above the polishing pad 11. As the pad surface roughness measuring device 38, a publicly known non-contact type surface roughness measuring device of an optical type or the like may be used. The pad surface roughness measuring device 38 is connected to the dressing monitoring apparatus 35 and measured values of surface roughness of the polishing pad 11 is sent to the dressing monitoring apparatus 35.

A film thickness sensor (film thickness measuring instrument) 39 for measuring a film thickness of the wafer W is disposed in the polishing table 12. The film thickness sensor 39 is disposed so as to face the surface of the wafer W held to the top ring 20. The film thickness sensor 39 is a film thickness measuring instrument that measures the film thickness of the wafer W while moving across the surface of the wafer W along with the rotation of the polishing table 12. As the film thickness sensor 39, a non-contact type sensor such as an eddy current sensor or an optical sensor may be used. A measured value of the film thickness is sent to the dressing monitoring apparatus 35. The dressing monitoring apparatus 35 is configured to generate a film thickness profile of the wafer W (a film thickness distribution along the radius direction of the wafer W) from the measured value of the film thickness.

Next, swinging of the dresser 23 will be described with reference to FIG. 2. The dresser arm 26 turns around a point J clockwise and counterclockwise by a predetermined angle. The position of the point J corresponds to the center position of the spindle 31 shown in FIG. 1. As the dresser arm 26 turns, the rotation center of the dresser 23 swings in the radius direction of the polishing pad 11 within a range shown by a circular arc L.

Figure 3:
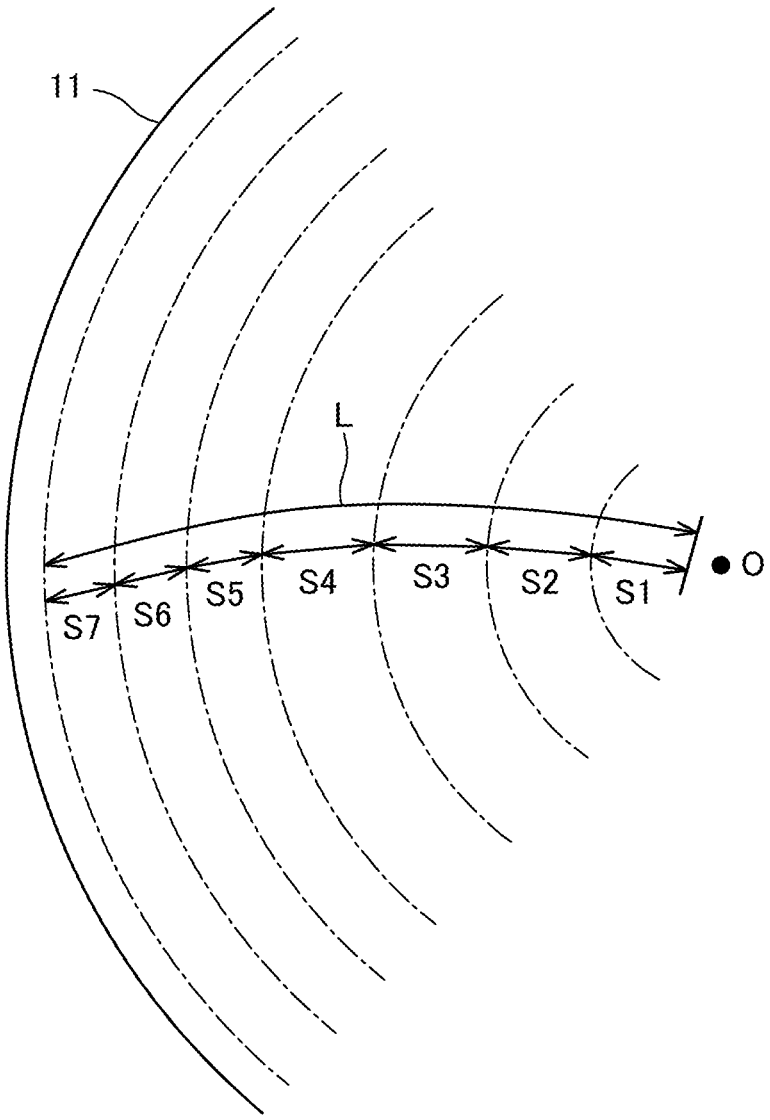
FIG. 3 is a diagram illustrating examples of scanning areas set on a polishing pad.

FIG. 3 is an enlarged view of the polishing surface 11*a* of the polishing pad 11. As shown in FIG. 3, the swing range (swing width L) of the dresser 23 is divided into a plurality of (7 in the example in FIG. 3) scanning areas (swing sections) S1 to S7. These scanning areas S1 to S7 are virtual spaces set in advance on the polishing surface 11*a* and arranged side by side along the swing direction of the dresser 23 (that is, roughly in the radius direction of the polishing pad 11). The dresser 23 dresses the polishing pad 11 while moving across these scanning areas S1 to S7. Lengths of the scanning areas S1 to S7 may be identical or different from each other.

Figure 4:
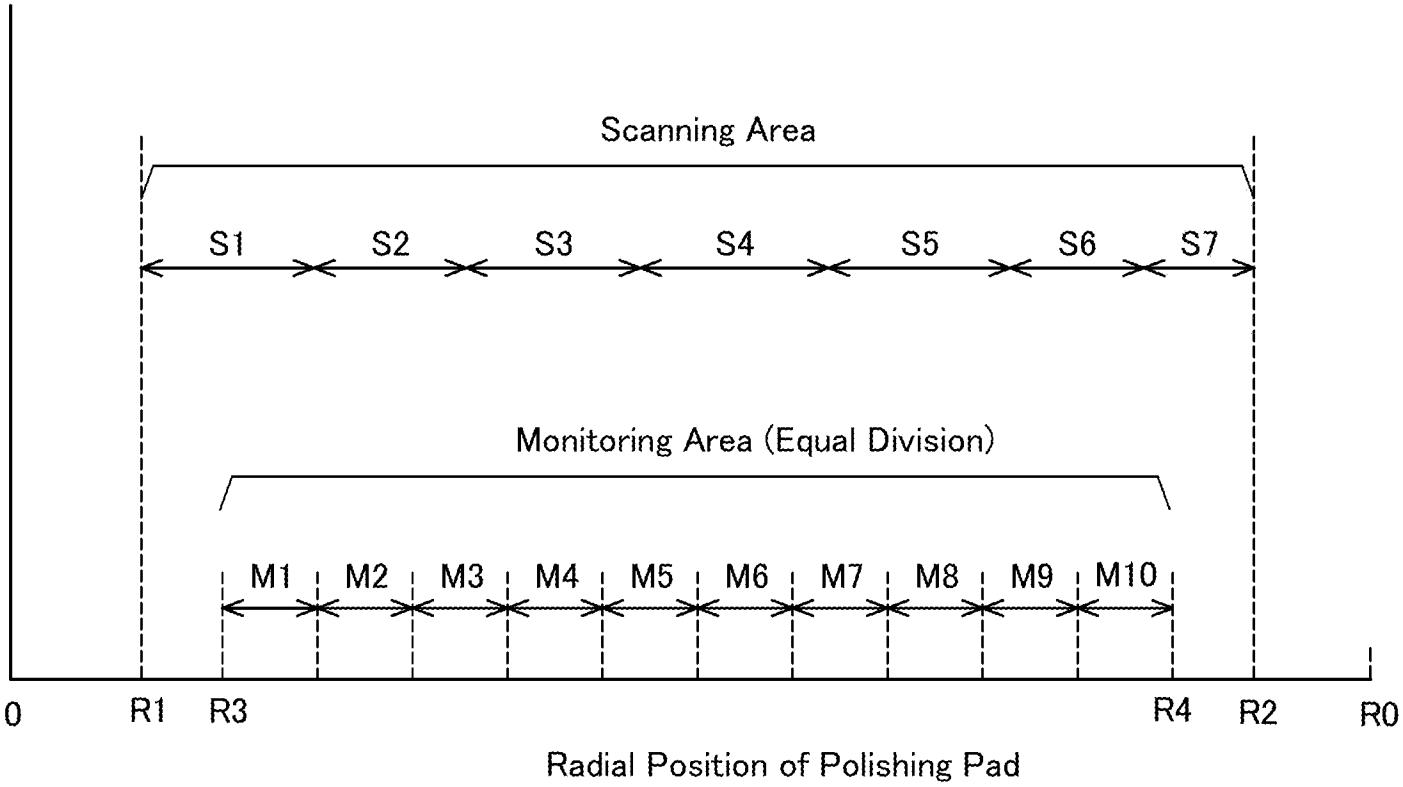
FIG. 4 is an explanatory diagram illustrating a relationship between a scanning area and a monitoring area of the polishing pad.

FIG. 4 is an explanatory diagram illustrating a positional relationship between scanning areas S1 to S7 and monitoring areas M1 to M10 of the polishing pad 11 and the horizontal axis in FIG. 4 represents a distance from the center of the polishing pad 11. A case is shown in the present embodiment as an example where seven scanning areas and ten monitoring areas are set, but the numbers of scanning areas and monitoring areas may be changed as appropriate. Since it is difficult to control the pad profile in an area having a width corresponding to the radius of the dresser 23 from both ends of the scanning areas, monitoring exclusion widths are provided inside (areas R1 to R3 from the center of the pad) and outside (areas R4 to R2 from the center of the pad), but monitor exclusion widths need not always be provided.

The moving speed of the dresser 23 when swinging over the polishing pad 11 is set for each scanning area S1 to S7 in advance and can also be adjusted as appropriate. The moving speed distribution of the dresser 23 represents the moving speed of the dresser 23 in each scanning area S1 to S7.

The moving speed of the dresser 23 is one of determining elements of the pad height profile of the polishing pad 11. The cut rate of the polishing pad 11 represents an amount (thickness) per unit time of the polishing pad 11 shaved by the dresser 23. When the dresser is moved at a constant speed, the thickness of the polishing pad 11 shaved in each scanning area normally differs from one scanning area to another, and so the numerical value of the cut rate also differs from one scanning area to another. However, since it is normally preferable to keep the initial shape of the pad profile, the moving speed is adjusted so as to decrease the difference in the amount of shaving for each scanning area.

Here, increasing the moving speed of the dresser 23 means shortening the staying time of the dresser 23 on the polishing pad 11, that is, reducing the amount of shaving of the polishing pad 11. On the other hand, decreasing the moving speed of the dresser 23 means increasing the staying time of the dresser 23 on the polishing pad 11, that is, increasing the amount of shaving of the polishing pad 11. Therefore, by increasing the moving speed of the dresser 23 in a certain scanning area, it is possible to reduce the amount of shaving in the scanning area, and by decreasing the moving speed of the dresser 23 in a certain scanning area, it is possible to increase the amount of shaving in the scanning area. Thus, the pad height profile of the whole polishing pad can be adjusted.

Figure 5:
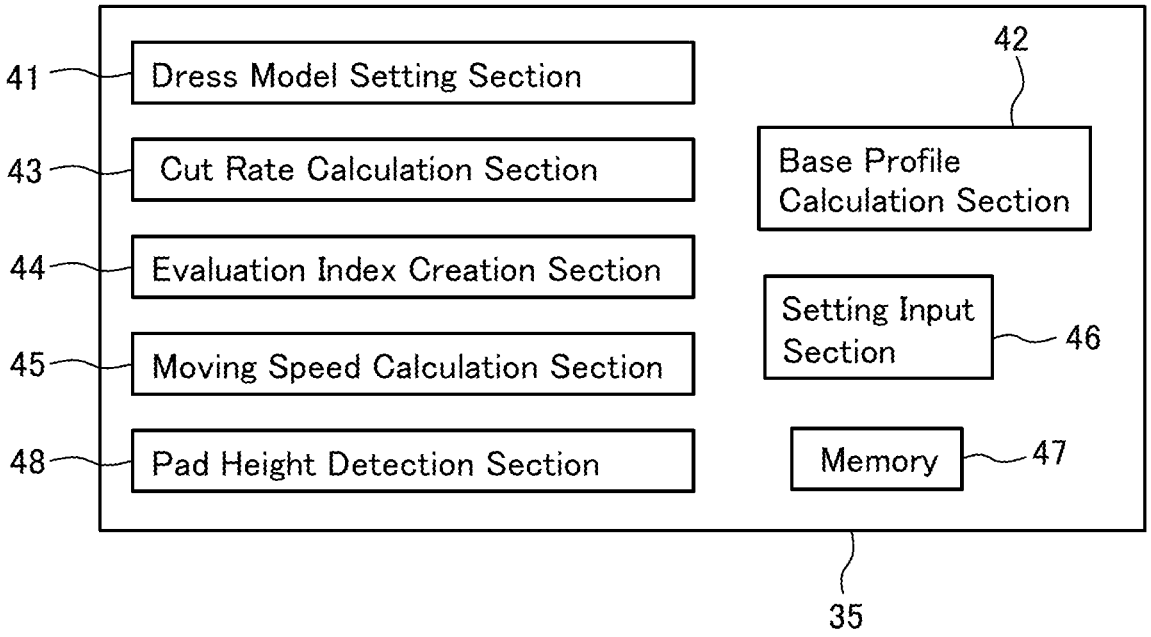
FIG. 5 is a block diagram illustrating an example of a configuration of a dresser monitoring apparatus.

As shown in FIG. 5, the dressing monitoring apparatus 35 is provided with a dress model setting section 41, a base profile calculation section 42, a cut rate calculation section 43, an evaluation index creation section 44, a moving speed calculation section 45, a setting input section 46, a memory 47 and a pad height detection section 48, and is configured to acquire a profile of the polishing pad 11 and set the moving speed of the dresser 23 to be optimum in scanning areas at predetermined timing.

The dress model setting section 41 sets a dress model S to calculate an amount of polishing of the polishing pad 11 in a scanning area. The dress model S is a real number matrix with m rows and n columns when it is assumed that the number of division of monitoring areas is m (10 in the present embodiment), the number of division of monitoring areas is n (7 in the present embodiment), and is determined by various parameters which will be described later.

When it is assumed that the scanning speed of the dresser in each scanning area set by the polishing pad 11 is $V=[v_1, v_2, \ldots, v_n]$, the width of each scanning area is $W=[w_1, w_2, \ldots, w_n]$, the staying time of (the center of) the dresser in each scanning area is expressed by:

$$T=W/V=[w_1/v_1, w_2/v_2, \ldots, w_n/v_n]$$

At this time, when an amount of wear of the pad in each monitoring area is assumed to be $U=[u_1, u_2, \ldots, u_m]$, the amount of wear of the pad U is calculated by carrying out a matrix calculation of U=ST using the aforementioned dress model S and the staying time T in each scanning area.

To derive the dress model matrix S, it is possible to consider elements of 1) a cut rate model, 2) a dresser diameter and 3) scanning speed control and combine the elements as appropriate. The cut rate model is set on the assumption that each element of the dress model matrix S is proportional to the staying time in the monitoring area or proportional to scratch distance (moving distance).

Regarding the dresser diameter, each element of the dress model matrix S is set on the assumption that the dresser diameter is taken into consideration (the polishing pad is worn according to the same cut rate over the entire effective area of the dresser) or not taken into consideration (according to the cut rate only at the center position of the dresser). When the dresser diameter is taken into consideration, it is possible to define an appropriate dress model also for a dresser in which diamond particles are applied in a ring shape, for example. Furthermore, regarding the scanning speed control, each element of the dress model matrix S is set depending on whether a change in the moving speed of the dresser is in a stepped shape or slope shape. By combining these parameters as appropriate, it is possible to calculate an amount of cut that matches the embodiment from the dress model S and calculate a correct profile predicted value.

The pad height detection section 48 is configured to detect the pad height in each monitoring area by associating height data of the polishing pad consecutively measured by the pad height sensor 32 with measurement coordinate data on the polishing pad.

Figure 6:
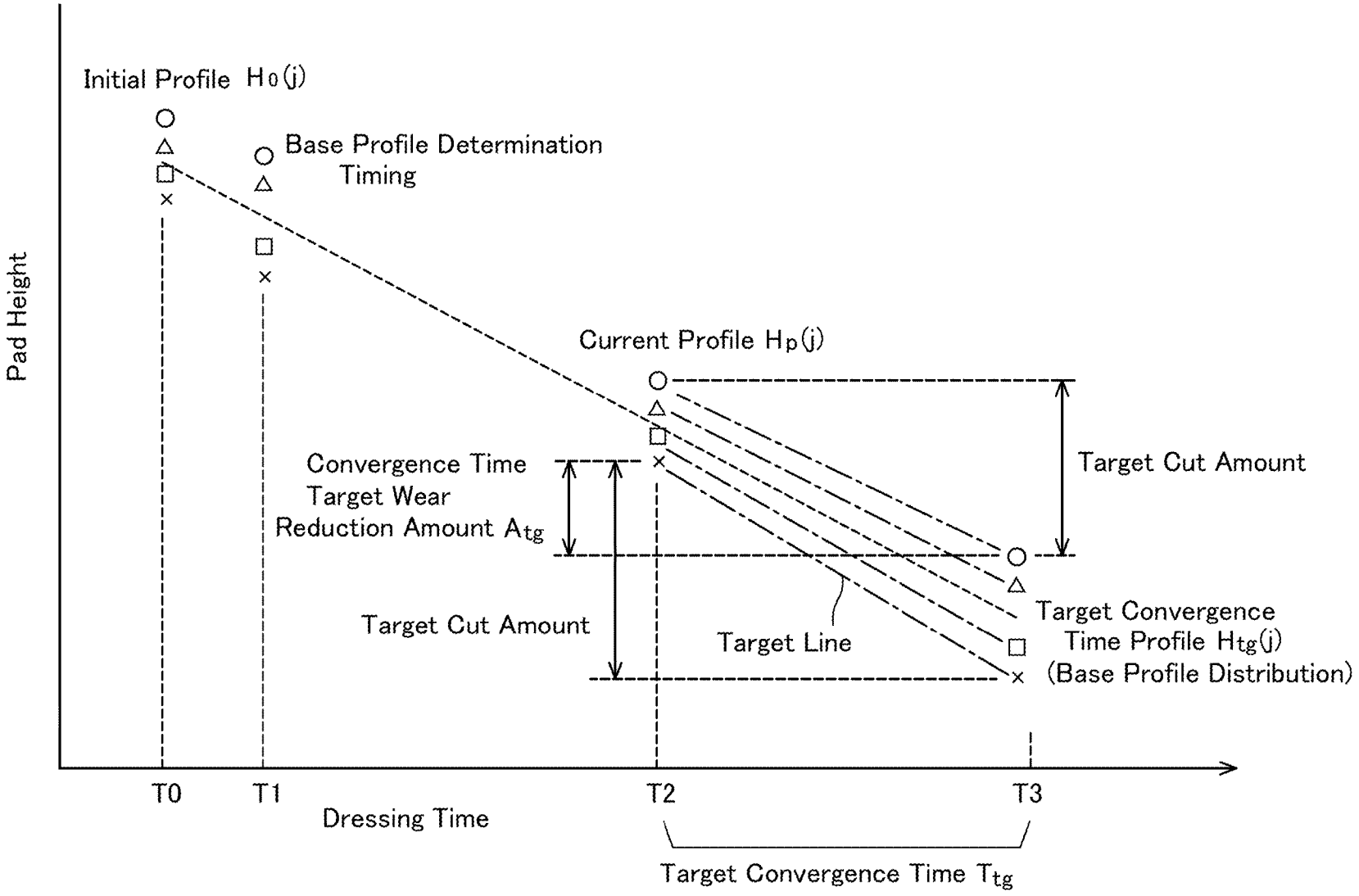
FIG. 6 is an explanatory diagram illustrating an example of profile transition of the polishing pad height in each scanning area.

The base profile calculation section 42 calculates a target profile (base profile) of the pad height during convergence (see FIG. 6). The base profile is used to calculate a target amount of cut used in the moving speed calculation section 45 which will be described later. The base profile may be calculated based on the height distribution (Diff(j)) of the polishing pad in a pad initial state and the measured pad height or may be given as a set value. When the base profile is not set, it is possible to calculate a target cut amount where the shape of the polishing pad becomes flat.

A base of the target cut amount is calculated using a pad height profile $H_p(j)$ [j=1, 2 . . . m] indicating a pad height for each monitoring area at a current point in time and a target wear reduction amount $A_{tg}$ separately set in convergence by the following expression:

$$\min\{H_p(j)\}-A_{tg}$$

Furthermore, the target cut amount in each monitoring area can be calculated in consideration of the aforementioned base profile by the following expression:

$$\min\{H_p(j)\}-A_{tg}+\mathrm{Diff}(j)$$

The cut rate calculation section 43 calculates a cut rate of the dresser in each monitoring area. For example, the cut rate may also be calculated from tilt of a variation in the pad height in each monitoring area.

The evaluation index creation section 44 is intended to optimize the moving speed of the dresser in each scanning area by calculating an optimum staying time (swing time) in a scanning area and making a correction using an evaluation index which will be described later. The evaluation index is 1) a deviation from the target cut amount, 2) a deviation from the staying time according to a reference recipe and 3) an index based on a speed difference between neighboring scanning areas, and is a function of staying time $T=[w_1/v_1, w_2/v_2, \ldots, w_n/v_n]$ in each scanning area. The moving speed of the dresser is optimized by defining the staying time T in each scanning area so that the evaluation index becomes a minimum.

1) Deviation from Target Cut Amount

When the target cut amount of the dresser is assumed to be $U_0=[U_{01}, U_{02}, \ldots, U_{0m}]$, a deviation from the target cut amount is calculated by calculating the square value ($|U-U_0|^2$) of the difference from the aforementioned pad wear amount U (=ST) in each monitoring area. Note that the target profile for determining the target cut amount can be determined at any timing after starting to use the polishing pad or may be determined based on a manually set value.

2) Deviation from Staying Time According to Reference Recipe

Figure 7:
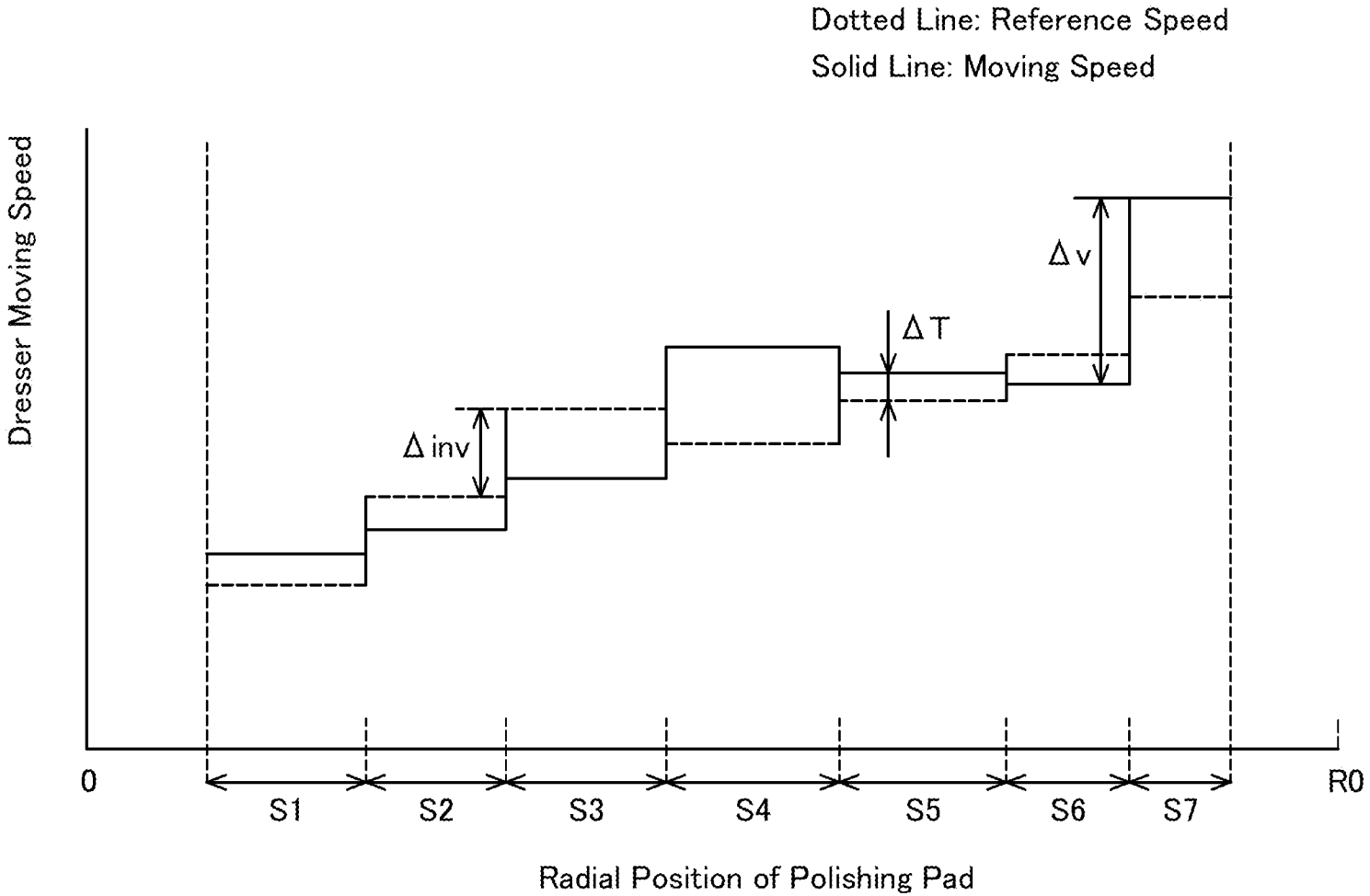
FIG. 7 is an explanatory diagram illustrating an example of a dresser moving speed and a reference value in each scanning area.

As shown in FIG. 7, a deviation from the staying time according to a reference recipe can be calculated by calculating the square value ($\Delta T^2=|T-T_0|^2$) of a difference ($\Delta T$) between the moving speed of the dresser (reference speed (reference staying time $T_0$)) based on the reference recipe set in each scanning area and the moving speed of the dresser (staying time T of the dresser) in each scanning area. Here, the reference speed is a moving speed at which a flat cut rate is expected to be obtained in each scanning area and is a value obtained by experiment or simulation in advance. When the reference speed is obtained by simulation, the reference speed can be calculated by assuming that a scratch distance (staying time) of the dresser is proportional to a cut amount of the polishing pad. Note that the reference speed may be updated as appropriate according to the actual cut rate when the same polishing pad is in use.

3) Speed Difference Between Neighboring Scanning Areas

The polishing apparatus according to the present embodiment further suppresses influences accompanying a drastic change of the moving speed on the polishing apparatus by reducing a speed difference between neighboring scanning areas. That is, it is possible to calculate an index of the speed difference between neighboring scanning areas by calculating the square value ($|\Delta V_{inv}|^2$) of a speed difference between neighboring scanning areas. Here, as shown in FIG. 7, as a speed difference between the scanning areas, either a difference ($\Delta_{inv}$) in the reference speed or a moving speed ($\Delta_v$) of the dresser can be used. Note that since the width of the scanning area has a fixed value, the index of the speed difference depends on the staying time of the dresser in each scanning area.

The evaluation index creation section 44 defines an evaluation index J shown in the following equation based on these three indices.

$$J=\gamma|U-U_0|^2+\lambda|T-T_0|^2+\eta|\Delta V_{inv}|^2$$

Here, a first term, a second term and a third term on the right side of the evaluation index J are indices resulting from the deviation from the target cut amount, the deviation from the staying time according to a reference recipe and the speed difference between neighboring scanning areas, and all the terms depend on the staying time T of the dresser in each scanning area.

The moving speed calculation section 45 performs optimization calculation such that the value of the evaluation index J becomes a minimum value, calculates the staying time T of the dresser in each scanning area and corrects the moving speed of the dresser. As an optimization calculation technique, a quadratic programming method can be used, but convergence calculation using simulation or PID control may also be used.

In the above evaluation index J, the values $\gamma$, $\lambda$ and $\eta$ are predetermined weighted values and can be changed as appropriate when the same polishing pad is in use. By changing these weighted values, it is possible to adjust indices to which greater importance is given as appropriate according to the characteristic of the polishing pad or the dresser or the operating situation of the apparatus.

Note that when calculating the moving speed of the dresser, it is preferable to ensure that the total dress time falls within a predetermined value range. Here, the total dress time refers to a moving time of the entire swing section (scanning areas S1 to S7 in the present embodiment) by the dresser. When the total dress time (time required for dressing) increases, other steps such as a wafer polishing step or a transporting step may be affected, and so it is preferable to correct the moving speed in each scanning area as appropriate in order to prevent the value from exceeding the predetermined value. Since there are mechanical constraints on the apparatus, it is preferable to set the moving speed of the dresser such that the maximum (and minimum) moving speed of the dresser and the ratio of the maximum speed (minimum speed) to the initial speed fall within a set value range.

Note that when appropriate dress conditions are unknown in a combination of a new dresser and the polishing pad or when a reference speed of the dresser (reference staying time $T_0$) is not determined as in a case immediately after replacement of the dresser or the polishing pad, the moving speed calculation section 45 may determine an evaluation index J (shown below) using only the condition of deviation from the target cut amount and perform optimization (initial setting) of the moving speed of the dresser in each scanning area.

$$J=|U-U_0|^2$$

The setting input section 46 is an input device such as a keyboard or a mouse and configured to input various parameters such as a value of each component of the dress model matrix S, a setting of a constraint condition, a cut rate update cycle or a moving speed update cycle. The memory 47 stores various types of data such as data of a program for operating each component constituting the dressing monitoring apparatus 35, a value of each component of the dress model matrix S, a target profile, a weighted value of the evaluation index J and a set value of the moving speed of the dresser.

Figure 8:
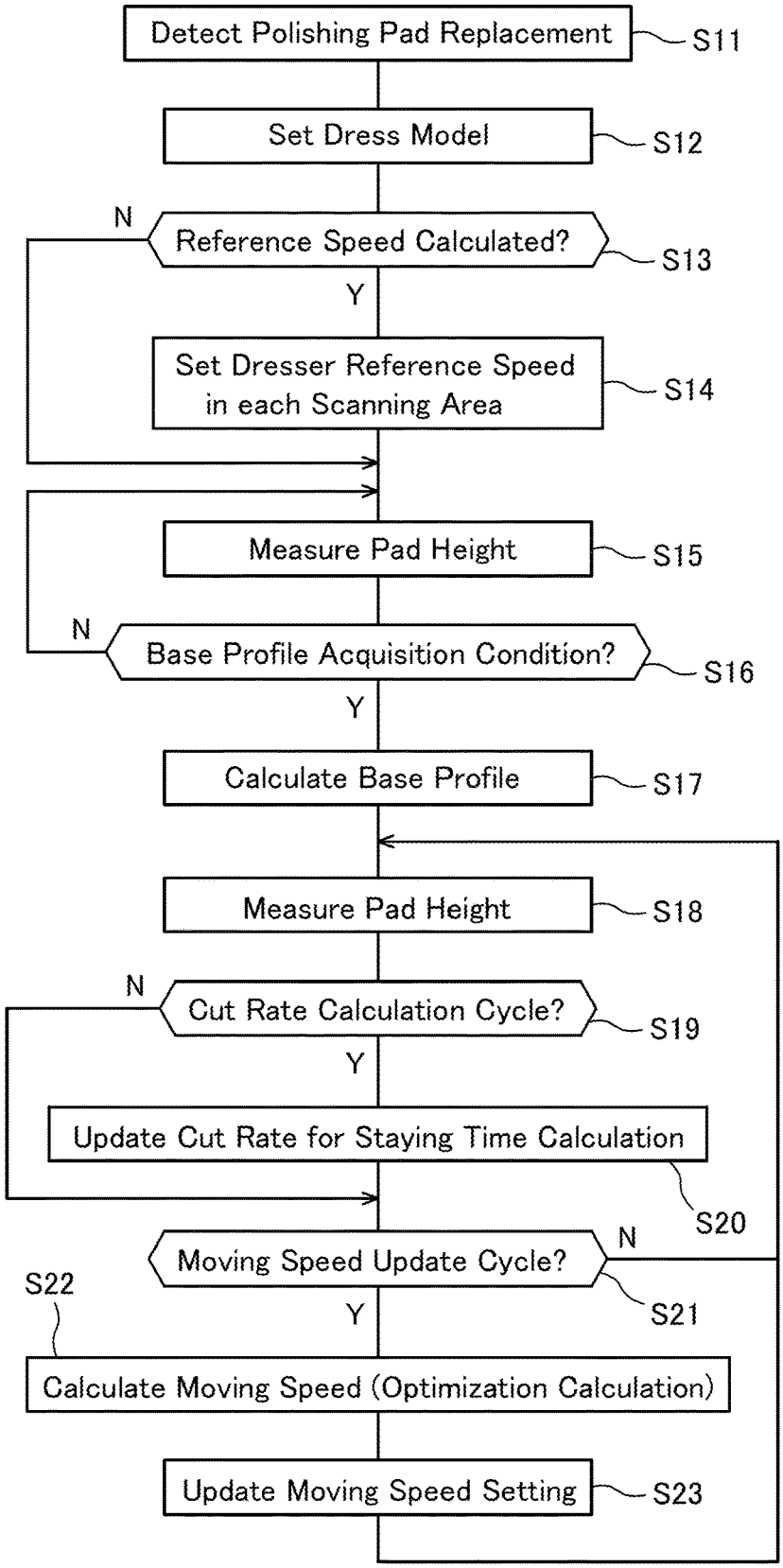
FIG. 8 is a flowchart illustrating an example of a dresser moving speed adjustment procedure.

FIG. 8 is a flowchart illustrating a processing procedure for controlling the moving speed of the dresser. Upon detecting that the polishing pad 11 is replaced (step S11), the dress model setting section 41 derives the dress model matrix S by taking into account parameters such as a cut rate model, a dresser diameter or scanning speed control (step S12). Note that in the case of the pad of the same type, the dress model matrix can be continuously used.

Next, it is determined whether or not to calculate a reference speed of the dresser (whether or not the setting input section 46 inputs an instruction for calculating a reference speed) (step S13). When calculating the reference speed, the moving speed calculation section 45 sets the moving speed (staying time T) of the dresser in each scanning area such that the next evaluation index J becomes a minimum value based on the target cut amount $U_0$ of the dresser and the pad wear amount U in each monitoring area (step S14). The calculated reference speed may be set as an initial value of the moving speed.

$$J=|U-U_0|^2$$

After that, when dressing processing on the polishing pad 11 is performed accompanying the polishing processing on the wafer W, the pad height sensor 32 measures the height (pad height) of the polishing surface 11*a* (step S15). It is determined whether or not the base profile acquisition condition (e.g., polishing of a predetermined number of wafers W) is satisfied (step S16) and if the condition is satisfied, the base profile calculation section 42 calculates a target profile (base profile) of the pad height in convergence (step S17).

After that, when dressing processing on the polishing pad 11 is performed accompanying the polishing processing on the wafer W, the pad height sensor 32 measures the height (pad height) of the polishing surface 11*a* (step S18). It is determined whether or not a predetermined cut rate calculation cycle (e.g., polishing on a predetermined number of wafers W) is reached (step S19) and if the predetermined cut rate calculation cycle is reached, the cut rate calculation section 43 calculates a cut rate of the dresser in each scanning area (step S20).

Furthermore, it is determined whether or not a moving speed update cycle of the dresser (e.g., polishing of a predetermined number of wafers W) is reached (step S21) and if the moving speed update cycle is reached, the moving speed calculation section 45 calculates a staying time of the dresser during which the evaluation index J becomes a minimum and thereby optimizes the dresser moving speed in each scanning area (step S22). The value of the optimized moving speed is set and the moving speed of the dresser is updated (step S23). After that, the flow is returned to step S18 and the above-described processing is repeated until the polishing pad 11 is replaced.

The above-described embodiment has been described on the assumption that the height of the polishing pad is lowered accompanying the polishing processing on the wafer W, but in the case where the processing on the wafer W is not performed for a while, the polishing pad may contain water and swell, and an apparent height of the polishing pad may increase. The amount of swelling of the polishing pad varies depending on the type of the polishing pad or a state of using the apparatus, but when the height of the polishing pad varies due to swelling, the cut rate to be used to calculate the evaluation index J becomes a negative value, and as a result, the moving speed of the dresser cannot be calculated or the calculated value may become an abnormal value, and in such a case, the performance of the polishing apparatus may be affected.

Figure 9:
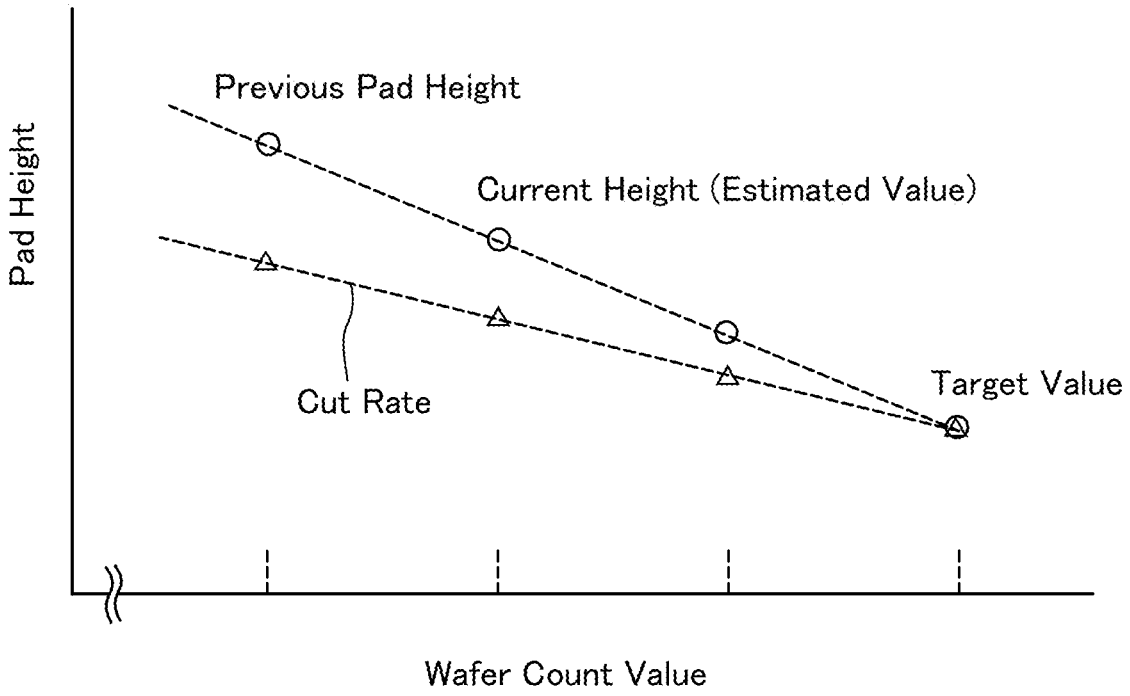
FIG. 9 is an explanatory diagram illustrating an example of a polishing pad height estimation method.

Therefore, as shown in FIG. 9, assuming that the (actual) cut rate of the polishing pad does not drastically change, the cut rate calculation section 43 may hold a calculated value of the latest (immediately preceding) cut rate and estimate the current pad height using the cut rate value and the previous value of the pad height. Thus, by calculating the moving speed of the dresser and the cut rate asynchronously, it is possible to avoid a situation in which the cut rate cannot be accurately calculated.

Note that the cut rate calculation interval may be preferably determined by a combination of the polishing pad and the dresser. Alternatively, as the cut rate calculation method, it may be possible to select any one of a method of calculating the cut rate from the initial pad height and the current height (measured value) of the polishing pad and a method of calculating the cut rate from the pad height when the previous cut rate is calculated and the current height of the polishing pad.

Furthermore, the monitoring target is not limited to the height of the polishing pad, but surface roughness of the polishing pad may be measured and the moving speed may be calculated such that the surface roughness may be made uniform.

The above-described embodiment has been described with the intention to allow a person ordinarily skilled in the art to which the present invention belongs to implement the present invention. Various modifications of the above-described embodiment can be naturally implemented by those skilled in the art and the technical thought of the present invention is also applicable to other embodiments. The present invention is not limited to the described embodiment, but should be interpreted within a broadest possible scope according to the technical thought defined in the scope of the appended claims.

What is claimed is:

1. A polishing apparatus that polishes a substrate placed on and in slidable contact with a polishing member, said polishing apparatus comprising:

a dresser that dresses the polishing member by swinging on the polishing member, a swing speed of which is adjustable in a plurality of scanning areas set on the polishing member along a swing direction;

a height detection section that measures a surface height of the polishing member in a plurality of monitoring areas set in advance on the polishing member along the swing direction of the dresser;

a dress model matrix creation section that creates a dress model matrix defined from a plurality of monitoring areas, scanning areas and a dress model;

an evaluation index creation section that calculates a height profile predicted value using the dress model, the swing speed in each scanning area or a staying time and sets an evaluation index based on a difference from a target value of a height profile of the polishing member; and a moving speed calculation section that calculates the swing speed in each scanning area of the dresser based on the evaluation index.

2. The polishing apparatus according to claim 1, wherein the evaluation index creation section sets the evaluation index based on a difference between the moving speed in the scanning area and a moving speed reference value.

3. The polishing apparatus according to claim 1, wherein the evaluation index creation section further sets the evaluation index based on a difference in the moving speed between the neighboring scanning areas.

4. The polishing apparatus according to claim 1, wherein the evaluation index creation section further sets the evaluation index based on a difference in moving speed reference values between the neighboring scanning areas.

5. The polishing apparatus according to claim 1, wherein the evaluation index creation section sets weighting factors with respect to the difference from the target value of the height profile of the polishing member, the difference from the reference value of the moving speed and the difference in the moving speed between the neighboring scanning areas.

6. The polishing apparatus according to claim 1, further comprising a cut rate calculation section that calculates cut rates of the polishing member in a plurality of monitoring areas.

7. The polishing apparatus according to claim 6, further comprising a storage section that stores the cut rates of the polishing member from the measured values of the surface height, wherein the polishing apparatus estimates the height profile of the polishing member based on the stored cut rates in the storage section.

8. The polishing apparatus according to claim 1, wherein as a dresser swing speed calculation condition, the moving speed calculation section provides constraints on a total time of a time period during which the dresser stays in each scanning area.

9. The polishing apparatus according to claim 1, wherein as a dresser swing speed calculation condition, the moving speed calculation section provides constraints on an upper limit value and a lower limit value of the swing speed of the dresser.

10. The polishing apparatus according to claim 1, wherein the moving speed calculation section executes an optimization calculation for minimizing the evaluation index to calculate the swing speed of the dresser.

11. The polishing apparatus according to claim 10, wherein the optimization calculation is a quadratic programming method.

12. The polishing apparatus according to claim 1, wherein the dress model matrix creation section sets the dress model matrix based on at least one element of a cut rate model, a dresser diameter and scanning speed control.

13. A dressing method for dressing a polishing member, said dressing method comprising:

dressing the polishing member by swinging a dresser on the polishing member, a swing speed of the dresser being adjustable in a plurality of scanning areas set on the polishing member along a swing direction;

measuring a surface height of the polishing member in a plurality of monitoring areas set in advance on the polishing member along the swing direction of the dresser;

creating a dress model matrix defined from the monitoring areas, the scanning areas and a dress model;

calculating a height profile predicted value using the swing speed or a staying time in the dress model and each scanning area;

setting an evaluation index based on a difference from the height profile target value of the polishing member; and setting the swing speed in each scanning area of the dresser based on the evaluation index.

14. The dressing method according to claim 13, further comprising the step of:

setting the evaluation index based on a difference between the moving speed in the scanning area and a moving speed reference value.

15. The dressing method according to claim 13, further comprising the step of:

setting the evaluation index based on a difference in the moving speed between the neighboring scanning areas.

16. The dressing method according to claim 13, further comprising the step of:

setting the evaluation index based on a difference in moving speed reference values between the neighboring scanning areas.

17. The dressing method according to claim 13, wherein as a dresser swing speed calculation condition, constraints are provided on an upper limit value and a lower limit value of the swing speed of the dresser.

18. The dressing method according to claim 13, wherein an optimization calculation for minimizing the evaluation is executed to calculate the swing speed of the dresser.

19. The dressing method according to claim 18, wherein the optimization calculation is a quadratic programming method.

20. The dressing method according to claim 13, wherein the dress model matrix is set based on at least one element of a cut rate model, a dresser diameter and scanning speed control.

* * * * *